United States Patent [19]

Harwood et al.

[11] 4,065,886

[45] Jan. 3, 1978

[54] PORTABLE ABRASION TOOL

[75] Inventors: William James Harwood, Saginaw; Robert P. Snyder, Bay City, both of Mich.

[73] Assignee: William James Harwood, Saginaw, Mich.

[21] Appl. No.: 714,364

[22] Filed: Aug. 16, 1976

[51] Int. Cl.[2] ..... B24B 41/00

[52] U.S. Cl. ..... 51/166 FB; 51/268

[58] Field of Search ..... 51/166 TS, 166 FB, 268, 51/270, 98 R; 144/35 A, 1 C

[56] References Cited

U.S. PATENT DOCUMENTS

| | | | |
|---|---|---|---|
| 2,888,965 | 6/1959 | Phillips | 51/166 FB |
| 3,568,378 | 3/1971 | Emerson et al. | 51/268 |
| 3,809,489 | 5/1974 | Harwood | 408/110 |
| 3,864,053 | 2/1975 | Harwood | 408/110 |

OTHER PUBLICATIONS

Sears, Roebuck & Co., 1975/76 Power & Hand Tool Catalog–Ht p. 75.

Craftsman Wood Service Co., Chicago, Illinois 60608, catalog 42, July, 1975–1976, pp. 12, 111 & 112.

*Primary Examiner*—Harold D. Whitehead
*Assistant Examiner*—Roscoe V. Parker
*Attorney, Agent, or Firm*—J. M. Kuszas; E. E. Schilling

[57] ABSTRACT

A portable apparatus for reducing the dimensions of a workpiece by abrading means. The apparatus comprises in combination: a portable electric drill motor having a tool shaft-receiving chuck; a workpiece abrading means operatively connected with a shaft adapted to be engaged by the chuck; a guide member supporting the drill motor; a base member adapted to receive and support (1) the guide member adjacent one end, and (2) a housing generally surrounding the abrading means adjacent the other end; the base member having retentive parallel positioning rails extending longitudinally along each lateral edge of a face of the base member; the guide member being slidable longitudinally of the base member whereby the drill motor is adjustably advanceable toward the end of the base member to allow the tool to be aligned with the housing or guard.

20 Claims, 11 Drawing Figures

PORTABLE ABRASION TOOL

BACKGROUND AND FIELD OF THE INVENTION

The present invention relates generally to a portable apparatus, and more in particular to a portable apparatus for reducing the dimensions of a workpiece by abrading means utilizing a portable electric drill motor as the drive means. Such drill motors include both battery driven and line driven motors.

Numerous motor driven tools are found in the prior art which are capable of reducing the dimensions of a workpiece by abrading means. These include grinding wheels, honing wheels, belt sanders, disc sanders, wire brush wheels, buffing wheels and the like. Generally each of these devices is either incorporated into a rather sturdy apparatus which is too heavy to be readily moveable from place to place or if portable, is not designed to be accurate, reliable, safe and durable. Furthermore, so far as is known, the abrasive means or tool head of the various prior art devices are not normally capable of being interchangeably driven by a single power unit such as a portable electric drill motor. This often requires the craftsman to acquire separately powered devices for each grinding, honing or sanding operation.

It is, therefore, desirable to provide a single portable apparatus for reducing the dimensions of a workpiece which apparatus includes an electric drill motor, rotatable abrading means, and a jig for adjustably positioning the electric drill motor and the abrading means in operative relationship, the abrading means including grinding, honing and belt or disc sanding devices or tool heads, the entire apparatus being not only portable but accurate, reliable, safe and durable, while being relatively inexpensive to construct and maintain.

SUMMARY OF THE INVENTION

The apparatus of the present invention is a portable apparatus for reducing the dimensions of a workpiece by abrading means. In basic essence, the apparatus comprises: a portable electric drill motor; rotatable workpiece abrading means; a housing generally surrounding at least a portion of said abrading means; a jig for adjustably positioning the electric drill motor and the housing in operative relationship, said workpiece abrading means being readily replaceable by alternative preselected rotatable workpiece abrading means; said jig having a channelled base member and a guide member slidably engaging said base member for supporting and moving said electric drill motor. For purposes of the specification and claims, rotatable workpiece abrading means include grinding wheels, honing wheels, disc sanders, wire brush wheels, buffing wheels and a belt sander wherein a driven roll is supportable in a tool shaft-receiving chuck of an electric drill motor. In a preferred form, the apparatus comprises in combination: a portable electric drill motor having a tool shaft-receiving chuck; a rotatable workpiece abrading means operatively connected with a shaft adapted to be engaged by said chuck; a guide member having supported thereon said drill motor; a base member having a first end and a second end and adapted to receive and support (1) adjacent the first end thereof said guide member and (2) adjacent the second end thereof a housing adapted to generally surround at least a portion of said abrading means; said base member having retentive substantially parallel positioning rails extending longitudinally along each lateral edge of a face of said base member; said guide member being slidable longitudinally of said base member whereby the drill motor mounted thereon is adjustably positionable with respect to the second end of said base member whereby a tool with its shaft engaged in the chuck of the drill motor is suitably aligned with a guard or housing placed on or affixed to said second end of the base member; said base member being substantially coextensive with the combination of said guide member and said housing.

If desired a liquid reservoir adapated to be removably nested in the housing can be provided to receive a lower portion of the workpiece abrading means as for honing. In another preferred form of the present apparatus a battery-operated light assembly having the bottom portion of the housing for the battery adapted to be positioned on or to engage the positioning rails of the base member is provided adjacent the housing, ordinarily on the side of the housing remote from the guide member.

SUMMARY DESCRIPTION OF THE DRAWINGS

PARTICULARIZED DESCRIPTION OF THE INVENTION

Figure 1:
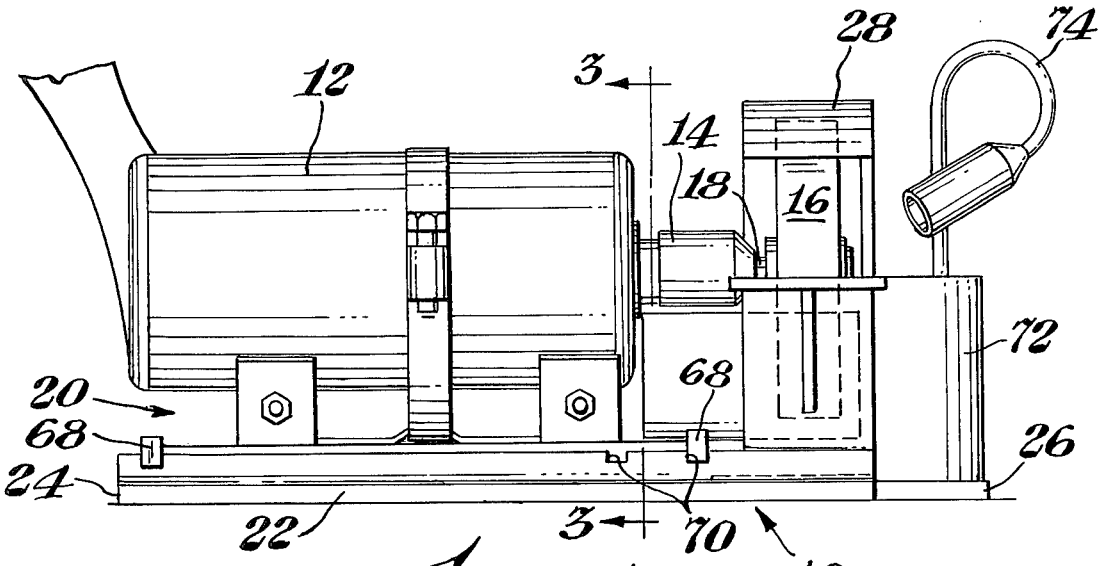
FIG. 1 is a view in side elevation of an embodiment of the apparatus in accordance with the present invention.
Figure 2:
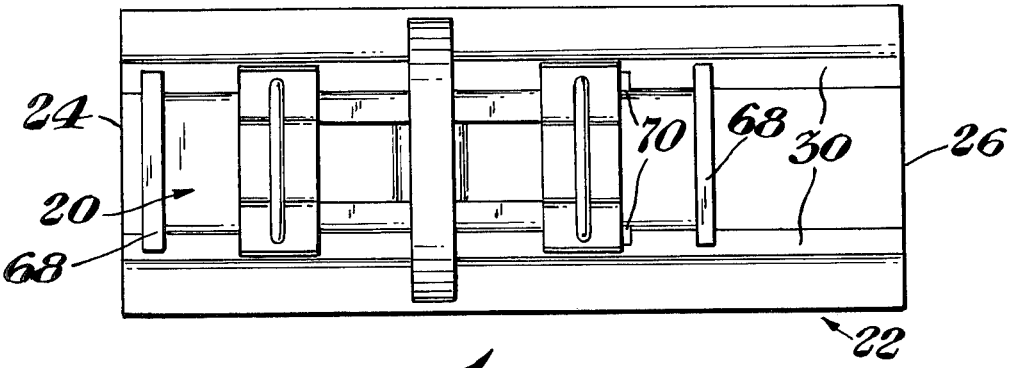
FIG. 2 is a plan view of the apparatus of FIG. 1 showing only the guide member supported on the base member with the drill motor omitted for clarity.
Figure 3:
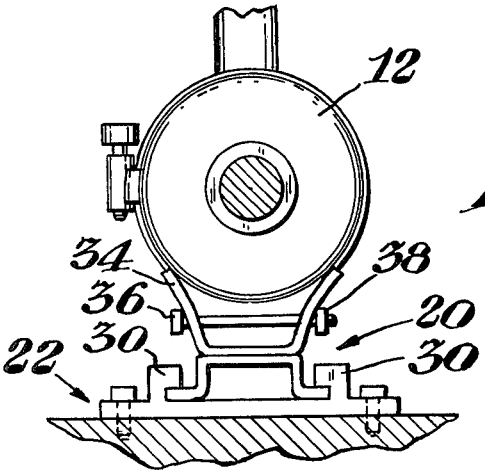
FIG. 3 is an end view in section of the apparatus taken along line 3—3 of FIG. 1.

Referring now to the embodiment illustrated in FIGS. 1, 2 and 3, there is depicted an apparatus in accordance with the present invention designated generally by the reference numeral 10. The apparatus 10 is seen to include a portable electric drill motor 12 having a tool shaft-receiving chuck 14; a workpiece abrading head 16 mounted upon a shaft 18 engaged by the tool shaft-receiving chuck 14; a guide member indicated generally by the numeral 20 having supported thereon the portable electric drill motor 12; and a planar, elongated rectangular base or channel member 22, having a first end 24 and a second end 26. The base member 22 supports the guide member 20 adjacent the first end 24 thereof and supports adjacent the second end 26 thereof a guard or housing 28 which is adapted to partially or substantially surround the workpiece abrading head 16.

The base member 22 has retentive parallel positioning rails 30 extending longitudinally along each lateral edge of a face of the base member 22. The guide member 20 when released is slidable longitudinally of the base member 22 and the portable electric drill motor 12 as supported in the guide member 20 is adjustably advanceable upon moving the guide member 20 toward the second end 26 of base member 22. To give proper support to the apparatus, the base member 22 must be substantially coextensive with the combination of the guide member 20 and the housing 28.

Figure 5:
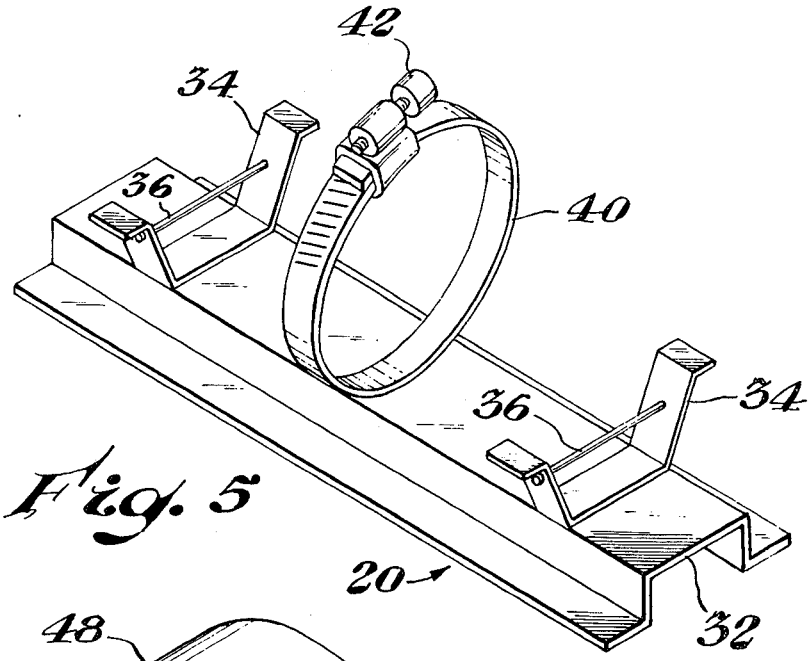
FIG. 5 is a view in isometric projection of the guide member for the drill motor shown in FIG. 1.

Referring now particularly to FIGS. 3 and 5, the guide member 20 is seen to include an elongated support member 32 having generally an inverted "U" shape section with the longitudinal edges terminating in outwardly extending flanges, the outwardly extending flanges being adapted to slide between the positioning rails 30 and to be retained by the inwardly extending longitudinal flange portion of such rails which form a part of the base member 22, as shown in FIG. 3. Two spaced-apart U-shaped support brackets 34 are attached closed sides back-to-back to the support member 32 adjacent each end of the support member 32. The support brackets 34 are adapted to cradle and support the portable electric drill motor 12. Compression means extend through each of the U-shaped support brackets 34 for selectively adjusting the spatial separation between upstanding arms of the U-shaped support brackets 34. Suitable compression means include a threaded fastening element such as bolt 36 extending through the face of each U-shaped support bracket 34 and secured by an element such as nut 38 threaded thereon. Any suitable compression and fastening means can be used in place of the bolt 36 and nut 38 provided that the compression produced thereby against the lateral faces of support brackets 34 will cause the spatial separation of the upstanding arms of the U-shaped support brackets 34 to be reduced or, if loosened, to expand to adapt to the curvature and dimensions of a wide variety of commercially available portable electric drill motors 12. The selective adjustability of the respective U-shaped brackets 34 of guide member 20 also affords and permits a leveling of the portable electric drill motor 12 so that the axis of the drill motor extends along a line substantially parallel to the plane of the guide member 20 and consequently also base member 22.

The guide member assembly 20 also includes fastening means attached to the support member 32 as by tack welding or riveting for firmly securing the portable electric drill motor 12 to the guide member 20 so that the drill does not move normal to its axis when it is in operation. The electric drill motor 12 may be fastened to the guide member 20 in most any way that holds the drill firmly so that it does not oscillate. However, the fastening means is conveniently and preferably a hose clamp 40, located at about mid-length of the guide member 20. Preferably, the hose clamp 40 is provided with an adjustable, threadable closure means 42 adaptable to receive various sizes and shapes of electric drill motors.

As is evident from FIG. 2, the guide member 20 is considerably shorter than the base member 22 so that a certain amount of movement is afforded the guide member 20 when it is slibably engaged in the base member 22. In nearly all applications it is desirable to have the guide member 20 remain at a predetermined position along the base member 22 during use. While the slidable engagement may be sufficient in some cases, it is preferred to assuredly fix the guide member 20. Accordingly, in one embodiment, the retentive parallel positioning rails 30 are notched as shown in FIGS. 1 and 2 to provide a plurality of pairs of horizontally aligned indexing slits 70 each pair being spaced apart the length of the guide member 20. The various pairs of indexing slits 70 are spaced along the parallel positioning rails 30 at positions corresponding to predetermined spacing needs between the guide member 20 and the housing 28, which spacing can vary depending on the abrading means employed, e.g., as determined by the length of drive shaft 18 to be engaged in the chuck 14 or the drill motor 12. A movable stopping means, such as frame key 68, drops into and is slidably held in one pair of the horizontally aligned indexing slits 70 at each end of the guide member 20. Each frame key 68 is of sufficient dimensions to block the guide member 20 and to prevent movement of the guide member 20 along the base member 22 in the direction of the frame key 68.

Figure 4:
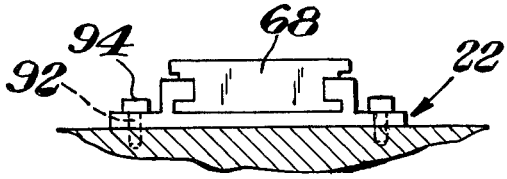
FIG. 4 is an end view in section of the apparatus taken along line 3—3 of FIG. 1 showing only locking means engaged in the base member.

In the embodiment shown in FIGS. 3 and 4 the base member 22 is generally planar and rectangular in shape. The retentive longitudinal parallel positioning rails 30 upstanding from and substantially coextensive with the base member 22 are substantially inverted L-shaped in section. In the present embodiment, the base portion of the L is the distal end with respect to the base member 22. Preferably the positioning rails 30 are respectively spaced apart from each lateral edge of a face of the base member 22. Preferably, the base member 22 has apertures 92 therein for affixing the base to a supportive surface such as a horizontal surface by suitable fastening means such as bolt 94. Advantageously, other fastening means such as at least one "C" clamp or a vise can be employed to securing the base member 22.

Figure 7:
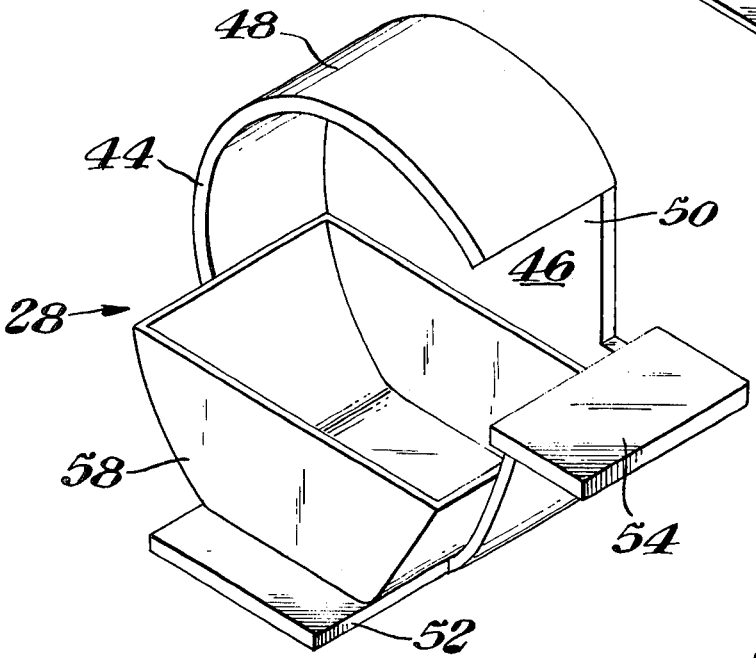
FIG. 7 is a view in isometric projection of the housing shown in FIG. 1.

Referring now to FIG. 7, there is illustrated an embodiment of the housing 28 of the present invention in which the housing 28 is substantially a partially enclosed body shell for axially receiving in an annularly spaced-apart relationship the workpiece abrading head 16 in its enclosure. The housing 28 includes a close end face 46, and a peripheral face 48 having an aperture 50 formed therein, and a lip 44 extending about an edge of the peripheral face 48 and defining an open end face of the housing 28. The aperture 50 in peripheral face 48 exposes a portion of the workpiece abrading head 16.

Figure 11:
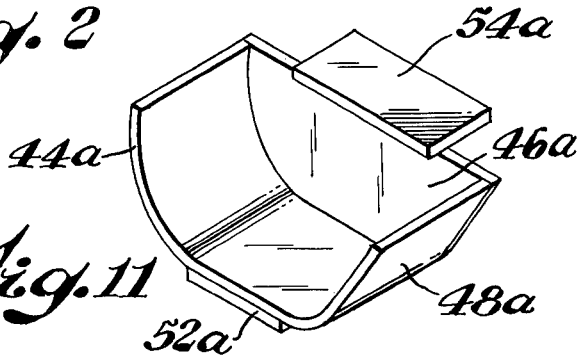
FIG. 11 is a reduced view in isometric porjection of another embodiment of the housing of the present invention.

The housing 28 includes a base or mounting means 52 integrally formed with the bottom portion of the peripheral face 48 and adapted to allow the housing 28 to slidably nest in the base member 22 adjacent the second end 26 of the base member 22. The housing 28 can be free standing and not permanently attached to any of the portable electric drill motor 12, the shaft 18, or the base member 22. Preferably, however, the housing 28 is attached as by bolting to the base member 22 or is compressed against the face of base member 22 with a set screw extending through one of the positioning rails 30. The exact dimensions of the housing 28 can vary with the magnitude of the workpiece abrading head enclosed therein. However, the housing 28 is of sufficient dimension that at least a portion of the workpiece abrading head is surrounded by, but spaced apart from, each of the closed end face 46, and the peripheral face 48 of the housing 28. In an embodiment in which the abrading head 16 is a sanding disc, the housing 28*a* can take the shape as shown in FIG. 11 in which the partial end face 46*a* facing away from the portable electric drill motor 12 is not closed but is cut away in part to permit access to the face of the disc, and the workpiece support 54a is located on such end face 46a.

Figure 8:
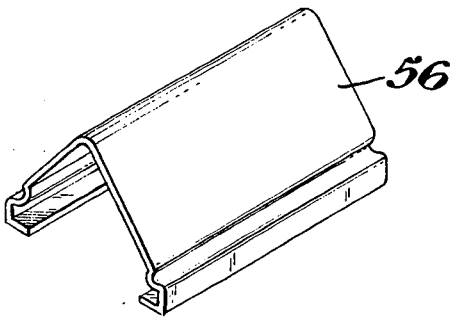
FIG. 8 is a view in isometric projection of a workpiece supporting clip adapted to be attached to the housing shown in FIG. 7.

The housing 28 preferably includes a workpiece supporting surface 54 extending from the peripheral face 48 of housing 28 adjacent the aperture 50 in the peripheral face 48. The workpiece supporting surface 54 allows a workpiece to be rested thereon while in contact with the workpiece abrading head 16 within the housing 28. In a preferred embodiment, a removable clip 56, such as that illustrated in FIG. 8, slidably engages and is mounted on opposed edges of the workpiece supporting surface 54 and provides a supporting surface having a predetermined angle with respect to the workpiece supporting surface 54. A number of removable clips 56, each accurately shaped to a different predetermined angle can interchangeably engage the workpiece support surface to provide a variety of useful working angles.

In a preferred embodiment, the housing 28 also includes a liquid reservoir 58. Liquid reservoir 58 is removably nested in the housing 28 such that the lower portion of the workpiece abrading head 16 is received by the liquid reservoir. In this configuration, with a suitable liquid, such as water or water thickened with a suitable gelling agent as understood in the wet honing art, e.g., polyvinyl pyrrolidone, in the liquid reservoir 58, the apparatus of the present invention is especially suitable for use as a low speed wet honing device.

Figure 6:
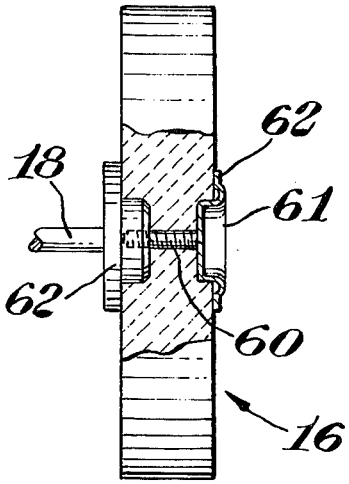
FIG. 6 is a view in side elevation, partly broken away and in section, of the workpiece abrading means shown in FIG. 1.

A variety of workpiece abrading means such as grinding wheels, honing wheels, belt sanders, disc sanders, wire brush wheels, buffing wheels, and the like can be used in the present apparatus. FIG. 6 illustrates a preferred embodiment wherein the workpiece abrading means is an abrading head 16 suited for either grinding or honing. In either operation, the head 16 resembles a horizontally disposed foreshortened cylinder-shaped abrasive disc or wheel containing in the center portion thereof, a foreshortened threaded axial shaft 60 which extends through the axial center of the head 16 which is compressively mounted on the shaft 60 by means of fastening element or nut 61 and washers 62. The foreshortened shaft 60 extends through the entire workpiece abrading head 16, and is sufficiently long to engage the tool shaft-receiving chuck 14 of the portable electric drill 12.

Figure 9:
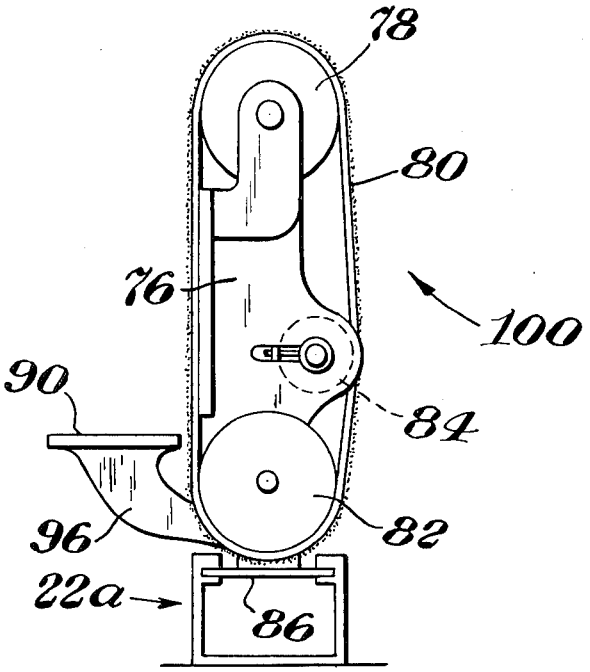
FIG. 9 is a side view of another embodiment of the housing of the present invention shown surrounding a belt sander abrading means.
Figure 10:
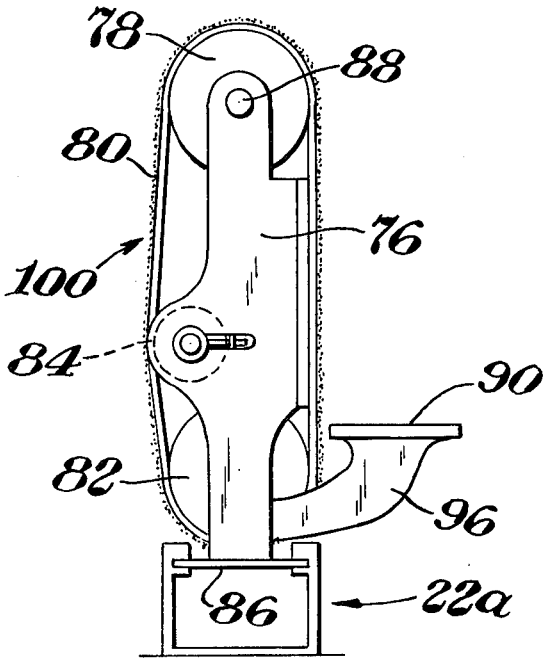
FIG. 10 is a side view of the housing of FIG. 9 as viewed from the opposite side.

Referring now to FIGS. 9 and 10, there is illustrated another embodiment of the present invention in which the workpiece abrading means is a belt sander assembly 100 contained within an appropriate frame structure 76 which serves as at least a partial housing. The assembly 100 comprises a vertically upstanding frame member 76 having rotatably supported thereby and adjacent one end thereof an idler roll 78 for guiding and supporting thereon, in connection with a driven roll 82 an endless flexible sanding belt 80 having abrasive particles affixed to the exposed surface thereof. The drive roll 82 is supported by the shaft 18 mounted in the tool shaft-receiving chuck 14 of the portable electric drill motor 12 and is positioned adjacent the other end of frame member 76 just above the mounting plate 86. The frame member 76 also carries a tension roll 84 mounted thereto and positioned between the idler roll 78 and the drive roll 82. The frame member 76 is attached to the channel-like base member 22a by means of the mounting plate 86 being slidably engaged in longitudinal groove in each of the inwardly flanges of the channel-like base constituting base member 22a. The idler roll 78 may be attached to the frame member 76 by any suitable mounting means such as an inverted "*h*" shaped bracket journalled to receive the axial shaft of the roll. However, a supporting means such as a bolt 88 freely passing through the center of the idler roll 78 serving as an axle and being attached at both ends to the frame member 76 is preferable. Preferably the frame member 76 includes a workpiece supporting surface 90 which is supported by frame arm portion 96.

As illustrated in FIG. 1 in one embodiment of the present apparatus, a battery-operated light assembly 72 having a bottom portion or base adapted to nest between or slidably engage the retentive side rails 30 of the base member 22 adjacent the housing 28 and disposed remotely from the guide member 20 is provided. As illustrated in FIG. 1, the light assembly 72 includes an arm 74 which is preferably flexibly deformable to permit optimum positioning of the light.

In using the apparatus of the present invention, in the embodiment shown in FIG. 1, a battery operated portable electric drill motor 12 is mounted, secured, and leveled on the guide member 20 with the handle grip up so that the tool shaft-receiving chuck 14 extends along a line substantially parallel to the plane of the guide member 20 and consequently also base member 22. The guide member 20 is engaged in the base member 22 by sliding the outwardly extending flanges of support member 32 between the retentive parallel positioning rails 30 adjacent the first end 24 of the base member 22. The housing 28, surrounding at least a portion of the workpiece abrading head 16, is engaged in the base member 22 by sliding the mounting means 52 securely between the retentive parallel positioning rails 30 adjacent the second end 26 of the base member 22. The guide member 20 is advanced toward the housing 28 until the tool shaft-receiving chuck 14 of the portable electric drill motor 12 engages the foreshortened shaft 60 of the workpiece abrading head 16. The tool-receiving chuck 14 is is then locked to securely hold the foreshortened shaft 60. Frame key 68 is then placed in slots 70 and prevents the guide member 20 from advancing along the base member 22. The portable electric motor 12 is turned on and the workpiece abrading head 16 is caused to rotate at a predetermined speed. The workpiece to be reduced in dimension is held on the workpiece support surface and manual pressure urges the workpiece into the abrasive surface of the abrading head 16, until the desired amount of the workpiece has been reduced by the abrading head 16.

When it is desired to hone the workpiece, the liquid reservoir 58 is inserted into the housing and filled with a quenching liquid such as water. When it is desired to sand the workpiece, belt sanding assembly 100 is engaged in the base member 22. When it is desired to disc sand, the housing 28a can be used.

If desired, and oftentimes with great advantage, other attachments to, changes, modifications or inclusions in embodiments of the present invention can be provided and utilized without departing substantially from its apparent and intended spirit and scope. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A portable apparatus for reducing the dimensions of a workpiece by abrading means comprising in combination:

a. a portable electric drill motor having a tool shaft-receiving chuck;

b. a rotatable workpiece abrading means operatively connected with a shaft adapted to be engaged by said chuck;

c. a guide member having supported thereon said drill motor;

d. a base member having a first end and a second end and adapted to receive and support (1) adjacent the first end thereof said guide member and (2) adjacent the second end thereof a housing adapted to generally surround at least a portion of said abrading means;

e. means for assuredly fixing each of said guide member and housing a predetermined distance along said base member;

said base member having retentive substantially parallel positioning rails extending longitudinally along each lateral edge of a face of said base member;

said guide member being slidable longitudinally of said base member between said retentive parallel positioning rails whereby the drill motor supported thereon is adjustably positionable with respect to the second end of said base member;

said housing being slidable longitudinally of said base member between said retentive parallel positioning rails; and said base member being substantially coextensive with the combination of the guide member and the housing.

2. The apparatus of claim 1 wherein the guide member comprises:

a. a support member having generally an inverted "U" shape section with longitudinal edges terminating in outwardly extending flanges adapted to cooperatively engage the rails of said base member;

b. two spaced-apart U-shaped support brackets attached to said support member adjacent each end thereof, for holding in a cradle-like arrangement said drill motor;

c. compression means extending through each of said support brackets for selectively adjusting the spatial separation between upstanding arms of said support brackets; and d. fastening means attached to said support member for securing said drill motor to said guide member.

3. The apparatus of claim 1 wherein the retentive rails of said base member are generally L-shaped in section with the base portion of the L being the distal end with respect to said base member.

4. The apparatus of claim 1 wherein the retentive positioning rails of said base member are inwardly extending flanges having longitudinal grooves formed therein.

5. The apparatus of claim 1 wherein the workpiece abrading means is mounted upon a foreshortened shaft.

6. The apparatus of claim 1 wherein the housing comprises:

a substantially enclosed body shell for axially receiving in an annularly spaced-apart relationship said workpiece abrading means, said body shell having an open end face, a closed end face and a peripheral face having an aperture formed therein for exposing a portion of said abrading means, said body shell having attached thereto mounting means for nesting said housing in said base member.

7. The apparatus of claim 6 including a workpiece supporting surface extending from said peripheral face of said housing adjacent the aperture in said peripheral face.

8. The apparatus of claim 7 including a clip removably mounted on opposed edges of said workpiece support surface for providing a workpiece supporting surface having a predetermined angle.

9. The apparatus of claim 6 wherein the workpiece abrading means is a honing wheel and the housing including a liquid reservoir adapted to be removably nested in said housing to receive a lower portion of said honing wheel.

10. The apparatus of claim 6 wherein the workpiece abrading means is a disc sander having an abrading face and a portion of the closed end face and a portion of the peripheral face of said housing partially cut away to permit access to the face of said disc sander.

11. The apparatus of claim 1 wherein the rotatable workpiece abrading means is selected from the group consisting of a grinding wheel, a honing wheel, a disc sander, a belt sander, a wire brush wheel and a buffing wheel.

12. The apparatus of claim 1 including indexing means spaced a predetermined distance along said positioning rails.

13. The apparatus of claim 12 including stopping means adapted to engage said indexing means for fixing said guide member a predetermined distance along said base member.

14. The apparatus of claim 1 wherein the drill motor is a battery operated motor.

15. The apparatus of claim 1 including a battery-operated light assembly having a bottom portion adapted to slidably engage the positioning rails of said base member adjacent said housing and disposed remotely from said guide member.

16. The apparatus of claim 1 wherein the housing comprises an assembly including a vertically upstanding frame member having rotatably supported thereon (1) adjacent one end thereof an idler roll for guiding and supporting thereon, in connection with a driven roll, adjacent the other end of said frame member a workpiece abrading means, said frame member including a tension roll positioned between said idler roll and said driven roll and mounting means for nesting said assembly in said base member.

17. The apparatus of claim 16 including a workpiece supporting surface extending from said frame member adjacent the mounting means.

18. The apparatus of claim 16 wherein the workpiece abrading means is a flexible belt having abrasive particles affixed to the exposed surface thereof.

19. An apparatus for mounting a portable electric drill motor and a housing therein in operative relationship which comprises:

a. a guide member adapted to support thereon said portable electric drill motor;

b. a base member having a first end and a second end and adapted to receive and support (1) adjacent the first end thereof said guide member and (2) adjacent the second end thereof said housing;

said base member having retentive substantially parallel positioning rails extending longitudinally along each lateral edge of a face of said base member;

said guide member and said housing each being slidable longitudinally of said parallel positioning rails;

said base member being substantially coextensive with the combination of said guide member and said housing and means for assuredly fixing each of said guide member and housing a predetermined distance along said parallel positioning rails.

20. A guide member for supporting thereon a portable electric drill motor comprising:

a. a support member having generally an inverted "U" shape section with longitudinal edges terminating in outwardly extending flanges adapted to engage a supporting base member;

b. two spaced-apart U-shaped support brackets attached to said support member adjacent each end thereof, for holding in a cradle-like arrangement said drill motor;

c. compression means extending through each of said support brackets for selectively adjusting the spatial separation between upstanding arms of said support brackets; and d. fastening means attached to said support member for securing said drill motor to said guide member.

* * * * *